US006953303B1

(12) United States Patent
Chase et al.

(10) Patent No.: US 6,953,303 B1
(45) Date of Patent: Oct. 11, 2005

(54) SUBSTRATE REMOVAL APPARATUS

(75) Inventors: Thomas Chase, Puyallup, WA (US); William Lingenfelter, Seattle, WA (US)

(73) Assignee: Waterwerks Inc., Sumner, WA (US)

( * ) Notice: Subject to any disclaimer, the term of this patent is extended or adjusted under 35 U.S.C. 154(b) by 0 days.

(21) Appl. No.: 10/420,112

(22) Filed: Apr. 18, 2003

Related U.S. Application Data

(60) Provisional application No. 60/437,577, filed on Dec. 31, 2002.

(51) Int. Cl.[7] ..... E01C 23/09
(52) U.S. Cl. ..... 404/94; 404/93; 404/75
(58) Field of Search ..... 404/75, 93, 94, 404/87, 6; 51/429

(56) References Cited

U.S. PATENT DOCUMENTS 4,183,987 A * 1/1980 Eby et al. ..... 428/192
4,219,155 A * 8/1980 Goerss ..... 239/124
4,221,271 A * 9/1980 Barker ..... 172/424
4,376,007 A * 3/1983 Eigenmann ..... 159/497
4,683,684 A * 8/1987 Yie ..... 451/92
4,753,549 A * 6/1988 Shook et al. ..... 404/75
4,793,734 A 12/1988 Shook et al.
4,854,770 A * 8/1989 Puchala et al. ..... 404/75
4,900,094 A * 2/1990 Sergeant ..... 299/39.6
5,492,431 A 2/1996 Rasmussen et al.
5,582,686 A * 12/1996 Chupka et al. ..... 162/194
5,613,800 A * 3/1997 Kneeland ..... 404/75
5,851,086 A * 12/1998 Kurasako ..... 404/94
6,131,557 A * 10/2000 Watson ..... 125/13.01
2001/0012475 A1 * 8/2001 Kishi ..... 404/75

* cited by examiner

*Primary Examiner*—Raymond W. Addie
(74) *Attorney, Agent, or Firm*—Christensen O'Connor Johnson Kindness PLLC

(57) ABSTRACT

A substrate removal apparatus capable of cutting a plurality of aligned, precision slots in a variety of surfaces, such as concrete, asphalt pavement, and other composite substrates, utilizes high-pressure liquid cutting devices. Slots may be cut in pavement for such applications as dowel bar retrofitting for joint load transfer restoration. An apparatus according to one embodiment includes a support frame, a carriage carried by the support frame, and cutting devices coupled to the carriage. The apparatus is configured so that the carriage is movable along a generally horizontal path of travel and a generally vertical path of travel.

26 Claims, 8 Drawing Sheets

SUBSTRATE REMOVAL APPARATUS

CROSS-REFERENCE TO RELATED APPLICATION

The present application claims the benefit of the filing date of U.S. Provisional Patent Application No. 60/437,577, filed Dec. 31, 2002, the disclosure of which is incorporated herein by reference.

FIELD OF THE INVENTION

The present invention relates to a substrate removal apparatus, and more particularly, to a substrate removal apparatus using high-pressure liquid cutting devices.

BACKGROUND OF THE INVENTION

Pavement on streets, highways, airstrips and the like is subject to wear and deterioration from, among other forces, the repeated travel of vehicles thereon. In the case of highways, one kind of deterioration, which is prevalent on well-traveled strips of pavement, is faulting at the transverse expansion joints between adjacent slabs of pavement. Where the wheel paths intersect the transverse joints, the pavement is known to suffer repeated heavy loading due to the passage of traffic. As a result, the pavement around the transverse joints is subject to a type of premature fatigue failure known as faulting.

Load transfer restoration (LTR) is known to improve load transfer across a joint and reduce the rate of future fault development. Joint load transfer is the capacity of a joint to distribute an approaching load by shear from one pavement slab to the adjacent pavement slab. The ability of a joint to distribute load is fundamental to its performance, with poor load transfer typically evidenced by a loss of structural integrity, such as faulting and, if not corrected, cracking and crumbling of the pavement near the joint.

One type of load transfer restoration (LTR) currently used in the industry is to utilize mechanical load transfer devices, such as steel dowel bars, in a process known as dowel bar retrofitting. Generally described, dowel bar retrofitting begins with creating aligned slots, typically one at a time, which straddle the transverse joint lines between adjacent pavement slabs. The slots are typically cut by a saw in the vehicle wheel paths, parallel to the pavement centerline and with each other. This is usually accomplished using saws equipped with diamond-impregnated blades that cut a single slot of the desired width and length, until all of the slots are formed. Once the slots are cut, the "plug" or remaining portion between the cuts is removed, usually by a jackhammer. Next, the slots are prepared to receive backfill material used to fill in the slots after the dowel bars have been installed. To prepare the slots, the slots are sand blasted to create slot surfaces that will establish a good bond between the backfill and slot walls, since a good bond is essential for load transfer performance. Once the preparation of the slot is complete, the dowel bars are inserted into the slots, and covered by backfill material.

One method of improving the speed and cost of dowel bar retrofitting is described in U.S. Pat. No. 5,492,431, to Rasmussen et al. Rasmussen et al. purportedly disclose a machine using twelve (12) wet cutting saw blades for simultaneously cutting sets of slots in the pavement. The blades move fore and aft on a carriage, and vertically up and down to cut the outer edges of the slots. Once the machine is finished cutting the slots, the machine moves to the next joint line to repeat the process, while a crew of men continue the process of removing the "plug," as well as preparing the slots prior to insertion of the dowel bar and backfill material.

While the machine of Rasmussen et al. provides the improved results of simultaneously cutting the slots using a single machine, the process of dowel bar retrofitting utilizing such a machine still has its disadvantages. For example, the blades of such a machine can become dull or break during constant usage, thereby requiring frequent and expensive replacement. Additionally, after such a machine is finished, the process still requires manual removal of the "plug" and preparation (e.g., sandblasting) of each slot so that the slots may be used for dowel bar retrofitting. The removal of the "plug" and preparation of the slots typically requires additional crew members at additional man-hours, which increases the cost and time required for completing the job.

SUMMARY OF THE INVENTION

The present invention addresses the aforementioned disadvantages and others by creating slots using high pressure fluid cutters that do not require additional preparation of the slots prior to insertion of the dowel bar and the subsequent backfilling of the slot with backfill material.

In accordance with aspects of the present invention, an apparatus for cutting at least one slot into a surface of a substrate is provided. The apparatus includes a support frame having a front end and a rear end and a carriage movably carried by the support frame. The carriage is reciprocally movable along a first path of travel between the front and rear ends of the support frame. The apparatus also includes at least one cutting device carried on the carriage for movement therewith. The cutting device includes at least one discharge orifice coupled in fluid communication with a source of high pressure liquid for supplying pressurized liquid to the orifice. The pressurized liquid is discharged from the cutting device by the discharge orifice for impinging against the surface of the substrate.

In accordance with another aspect of the present invention, an apparatus for cutting a plurality of slots into a surface of a substrate is provided. The apparatus includes a mobile support frame having a front end and a rear end, and a carriage moveably carried by the support frame. The carriage is reciprocally movable along a first path of travel between the front and rear ends of the support frame. The carriage is further reciprocally movable with respect to the support frame along a second path of travel substantially orthogonal to the first path of travel. The apparatus further includes a plurality of parallel cutting devices carried on the carriage for movement therewith. The cutting devices each include a tubular shaft and at least one discharge orifice coupled in fluid communication with the shaft, wherein the shafts are adapted to be connected to a source of high pressure liquid for supplying pressurized liquid to the shafts. The pressurized liquid is discharged from the cutting devices by the discharge orifices for impinging against the surface of the substrate.

In accordance with still another aspect of the present invention, an apparatus for cutting a plurality of slots into a surface of a substrate is provided. The apparatus includes a mobile support frame having a front end and a rear end and a carriage moveably carried by the support frame. The carriage is reciprocally movable along a generally horizontal path of travel between the front and rear ends of the support frame. The carriage is further reciprocally movable with respect to the support frame along a generally vertical path of travel. The apparatus also includes a plurality of parallel cutting devices carried on the carriage for movement therewith. The cutting devices each include a tubular shaft and at least one discharge orifice coupled in fluid communication with the shaft. The shaft has a generally vertical operating position and is adapted to be connected to a source of high pressure liquid for supplying pressurized liquid to the shaft. The pressurized liquid is discharged from the cutting device by the discharge orifice for impinging against the surface of the substrate. The apparatus further includes a first drive source drivingly connected to the carriage for effecting reciprocal movement of the carriage along the generally horizontal path of travel and a second drive source drivingly connected to the carriage for raising and lowering the carriage along the generally vertical reciprocal path of travel.

In accordance with yet another aspect of the present invention, a method for reinforcing a transverse joint in a road or substrate surface is provided. The method includes positioning a slot cutting apparatus over a road joint. The slot cutting apparatus includes a plurality of aligned, spaced-apart high pressure liquid cutting heads for cutting slots into the road at the road joint. A liquid is discharged at high pressure toward the road from the plurality of aligned high pressure liquid cutting heads carried by the apparatus for impinging the surface of the road so as to create a plurality of slots in the road. The plurality of cutting heads are moved along the road so as to elongate the slots, and then the apparatus is moved away from the joint. Mechanical reinforcing devices are placed into the slots and the slots are filled with new road material.

In accordance with still another aspect of the present invention, a method for simultaneously cutting a plurality of parallel slots in a surface of a substrate with a plurality of parallel high pressure liquid cutting heads carried on a frame is provided. The method includes positioning the frame in a desired location on the surface of the substrate with the plurality of cutting heads positioned above a portion of the surface of the substrate in which slots are to be cut. The plurality of cutting heads are positioned substantially orthogonal to the surface of the substrate. Liquid is discharged at high pressure from the plurality of high pressure liquid cutting heads to impinge against the surface of the substrate, thereby forming the plurality of parallel slots in the surface of the substrate. The plurality of cutting heads are moved from a first position in a first direction substantially parallel to the surface of the substrate and relative to the frame so that the slots are elongated. The plurality of cutting heads are lowered to a second position to reduce the distance between the cutting heads and the surface of the substrate so as to deepen the slots and the plurality of cutting heads are moved in a second direction opposite the first direction so that the deepened slots in the surface are elongated.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

The present invention will now be described with reference to the accompanying drawings where like numerals correspond to like elements. The present invention is directed to a substrate removal apparatus capable of cutting a plurality of aligned, precision slots in a variety of substrates, such as concrete, asphalt pavement, and other composite substrates. The present invention is particularly suited for an apparatus that utilizes high-pressure liquid cutting devices for cutting precision slots in pavement for such applications as dowel bar retrofitting for joint load transfer restoration. While the apparatus of the present invention has its primary application in dowel bar retrofitting for joint load transfer restoration, it will be appreciated that the apparatus of the present invention may be used in other applications desiring precision cutting and removal of substrate material. Thus, the following description relating to a substrate removal apparatus for use with dowel bars retrofitting is meant to be illustrative and not limiting the broadest scope of the invention, as claimed.

Figure 1:
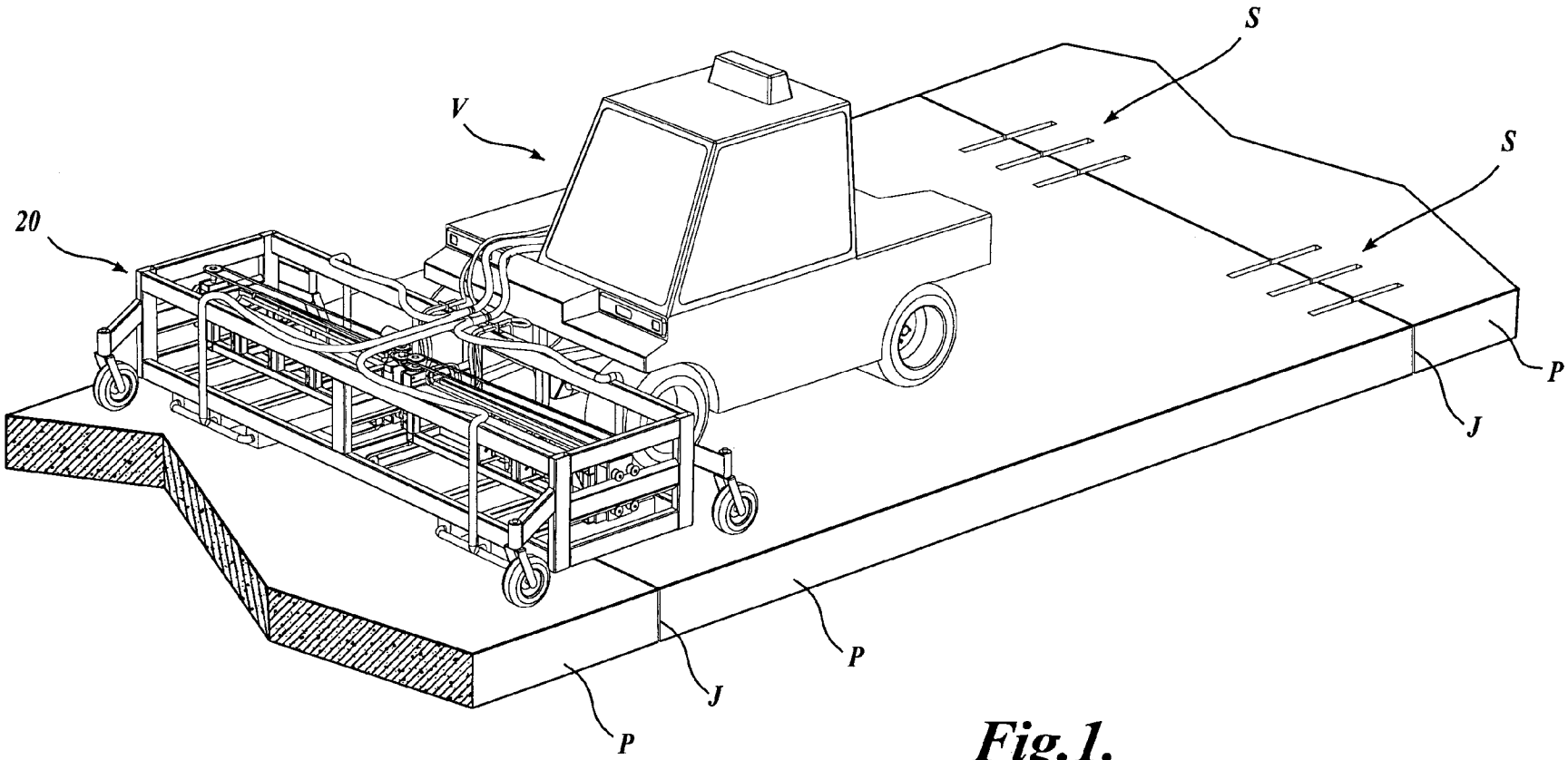
FIG. 1 is a perspective view of a substrate removal apparatus formed in accordance with an embodiment of the present invention, wherein the substrate removal apparatus is attached to a vehicle and is traversable over a substrate surface.

FIG. 1 is a perspective view of one suitable embodiment of a substrate removal apparatus 20 (hereinafter "the apparatus 20") for cutting precision slots S into a variety of substrates, which can include concrete, asphalt pavement, and other composite substrates. The apparatus 20 is adapted for traversing the surface of a substrate, which in one application may comprise adjacent slabs of pavement P that form transverse joints J. The apparatus 20, in one non-limiting embodiment, may be adapted to be connected to the front end of a vehicle V, which moves the apparatus 20 into the desired position for forming the slots S, for example, across the joint J. The apparatus 20 utilizes liquid discharged at pressures from about 10,000 psi to about 40,000 psi for impinging against the surface of the pavement P and causing the pavement P to erode in a uniform fashion, thereby forming the slots S.

In one embodiment, the vehicle V includes an internal drive source (not shown), such as an internal combustion engine, a set of steerable wheels, and a set of wheels driven by the internal drive source. The vehicle V also includes a hydraulic pump (not shown), a power take off (not shown) associated with the internal drive source to drive the hydraulic pump, and a hydraulic reservoir. The vehicle V is generally known in the art, and thus will not be described in any more detail.

Referring now to FIGS. 2–5, there are shown various views of the apparatus 20. The apparatus 20 includes a support frame 24, a carriage 28 reciprocally carried by the support frame 24, and a plurality of substrate cutting assemblies 32 (see FIG. 2) coupled the carriage 28. The support frame 24 includes four vertically oriented posts 36, 38, 40, and 42 at the corners of the frame 24, wherein the upper and lower ends of posts 36, 42 and 38, 40 are interconnected by horizontal beams 46, and wherein the upper and lower ends of the posts 36, 38, and 40, 42 are interconnected by horizontal beams 48. Vertical cross-braces 52 extend between the beams 48 at approximately their mid-spans at the front end and rear end of the support frame 24. Horizontal cross-braces 56, 58, and 60 extend between the front right post 38 and the rear right post 40, between the front left post 36 and the rear left post 42, and between the vertical cross-braces 52, respectively, at approximately their mid-spans (for clarity, the term "left" refers to the left side of the drawing in FIG. 2). The support frame 24 may include other cross braces, such as cross brace 62 (see FIG. 3), positioned between lower beams 48 and coplanar with cross brace 60.

The support frame 24 further includes wheel assemblies 66 mounted to the posts 36, 38, 40, and 42, through wheel assembly mounts 68. The wheel assemblies 66 include wheels 70 journaled for rotation to wheel brackets 72 about a horizontal axis so that the support frame 24 may roll upon the top surface of the substrate. The wheel brackets 72 are adapted for connection to the wheel mounts 68 such that the wheels 70 may swivel about an axis substantially parallel to the posts 36, 38, 40 and 42 and substantially orthogonal to the surface of the substrate for providing maneuverability to the support frame 24. In one embodiment, the support frame is approximately 130 inches wide by 36 inches long by 28 inches tall.

Still referring to FIGS. 2–5, the apparatus includes a carriage 28 movably supported by the support frame 24. The carriage 28 is composed of left and right carriage sections 80 and 82 positioned on the left and right sides of horizontal cross-brace 60 and vertical cross brace 52, respectively. The left and right carriage sections 80 and 82 are supported by the support frame 24 in a side-by-side manner and are preferably coupled together so as to move together as a unitary carriage. The left and right carriage sections 80 and 82 are substantially identical in construction and operation. Thus, for clarity in the ensuing description, only the left carriage section 80 will be explained in further detail.

Figure 6:
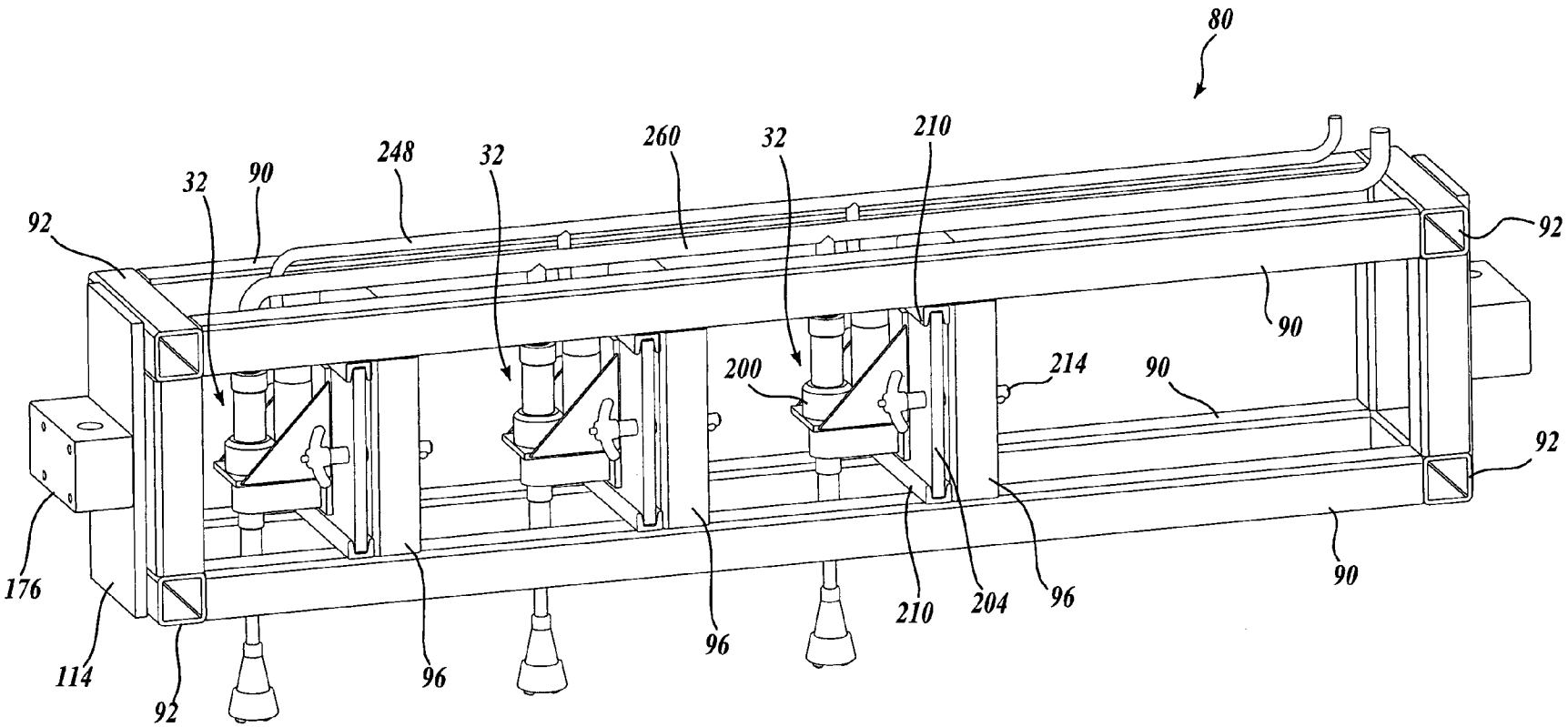
FIG. 6 is a perspective view of a carriage section formed in accordance with one embodiment of the present invention.

Turning now to FIG. 6, there is shown a perspective view of the left carriage section 80. The left carriage section 80 is constructed similar to the support frame but having somewhat smaller dimensions. The left carriage section 80 includes rectangular top and bottom frames formed by longitudinal beams 90 and lateral beams 92. To provide rigidity to the left carriage section 80 and to provide a mounting structure for the substrate cutting assemblies 32, as will be described in more detail below, vertical cross braces 96 extend between upper and lower longitudinal beams 90 in a spaced-apart manner. The left carriage section 80 may optionally include horizontal cross-braces (not shown in FIG. 6) extending between the bottom longitudinal beams 90 at approximately the location of the vertical cross-braces 96. As will be described below, the left carriage section 80 includes other components, which are not shown in FIG. 6 for ease of illustration.

Figure 4:
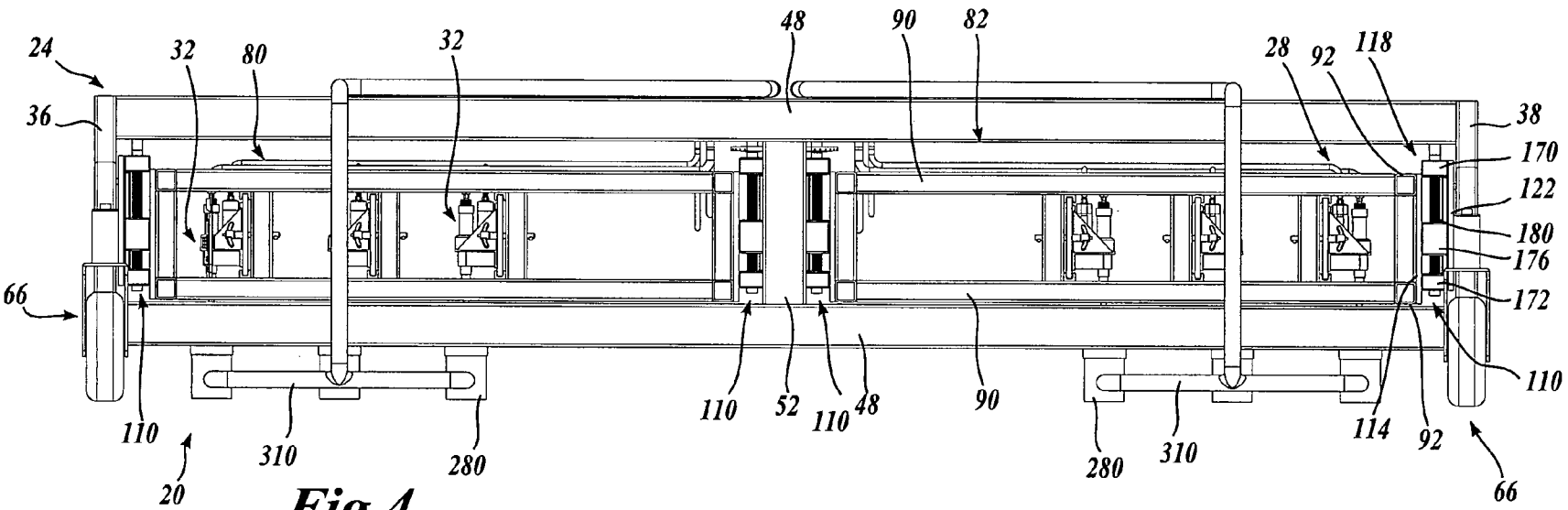
FIG. 4 is a front elevational view of the substrate removal apparatus of FIG. 2.
Figure 5:
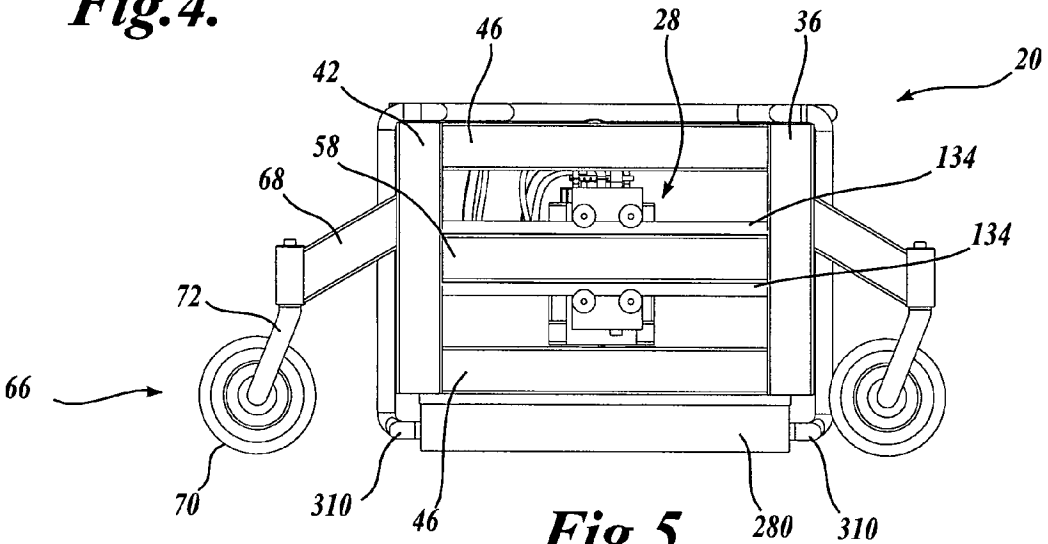
FIG. 5 is a side elevational view of the substrate removal apparatus of FIG. 2.

Returning to FIGS. 2 and 4, the carriage sections 80 and 82 are carried within the support frame 24 for movement in the fore and aft directions of the support frame 24, as well as being adapted for vertical movement relative to the support frame 24 when assembled. To accomplish such horizontal and vertical movement of the carriage 28, the ends of the carriage sections 80 and 82 are carried on the support frame 24 through travel assemblies 110 (see FIG. 4). As best shown in FIGS. 4 and 6, each travel assembly 110 includes a carriage mounting plate 114 secured to the beams 92, a linear actuator 118 operably connected to the mounting plate 114, and an end plate 122 secured to the linear actuator 118. The carriage mounting plate 114 may be secured to the beams 92 using any conventional methods, including rivets or welding to name a few.

Figure 2:
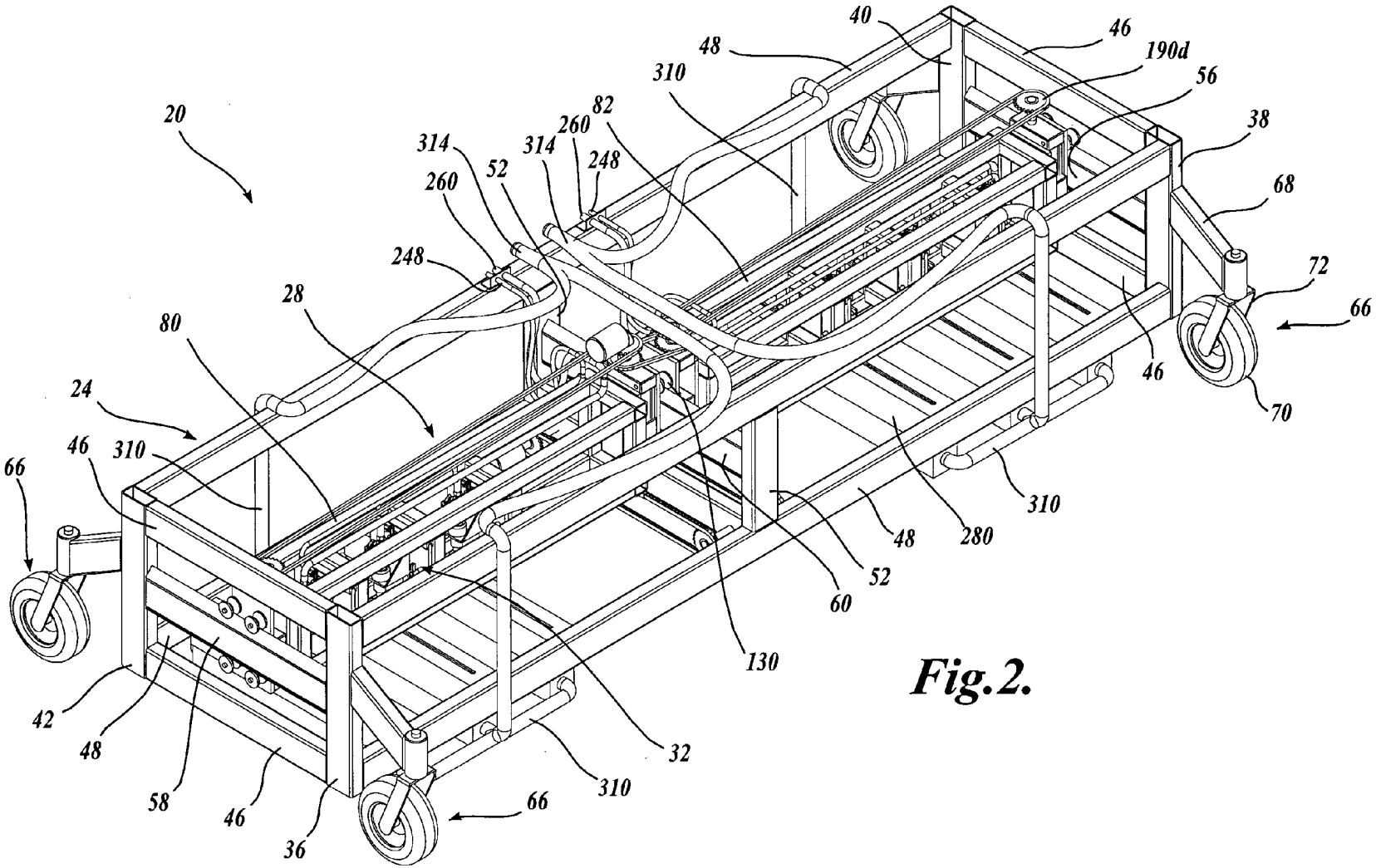
FIG. 2 is a top perspective view of the substrate removal apparatus of FIG. 1.

It will be appreciated by one skilled in the art that there are many ways to movably carry the carriage 28 within the support frame, of which one non-limiting example will now be described. The end plates 122 located at the outward ends of carriage sections 80 and 82 include spaced-apart stud shafts 128 that are secured to and project outwardly beyond the outward ends of the carriage sections 80 and 82, as shown best in FIG. 8. Journaled upon the stud shafts 128 are guide wheels or castors 130 having V-grooves. The V-groove castors 130 are guidably engaged on cooperating V-shaped guide rails 134 secured to the top and bottom surfaces of cross-braces 56 and 58 (cross brace 56 is shown in FIG. 2). In the embodiment shown in FIGS. 2, 3, and 7, the left and right carriage sections 80 and 82 are secured together by utilizing stud shafts (not shown) to interconnect the adjacent ends of left and right carriage sections 80 and 82. As such, castors 130 are journaled on the stud shafts disposed between the carriage sections and are guidably engaged to rails 134 on the center cross-brace 60, as shown best in FIG. 7. The foregoing assembly permits the carriage 28 to be guidably carried within the support frame 24 for reciprocal fore and aft movement with respect to the support frame 24. In one embodiment, the carriage is permitted to reciprocate along a substantially horizontal path of travel of approximately 20–28 inches.

Figure 3:
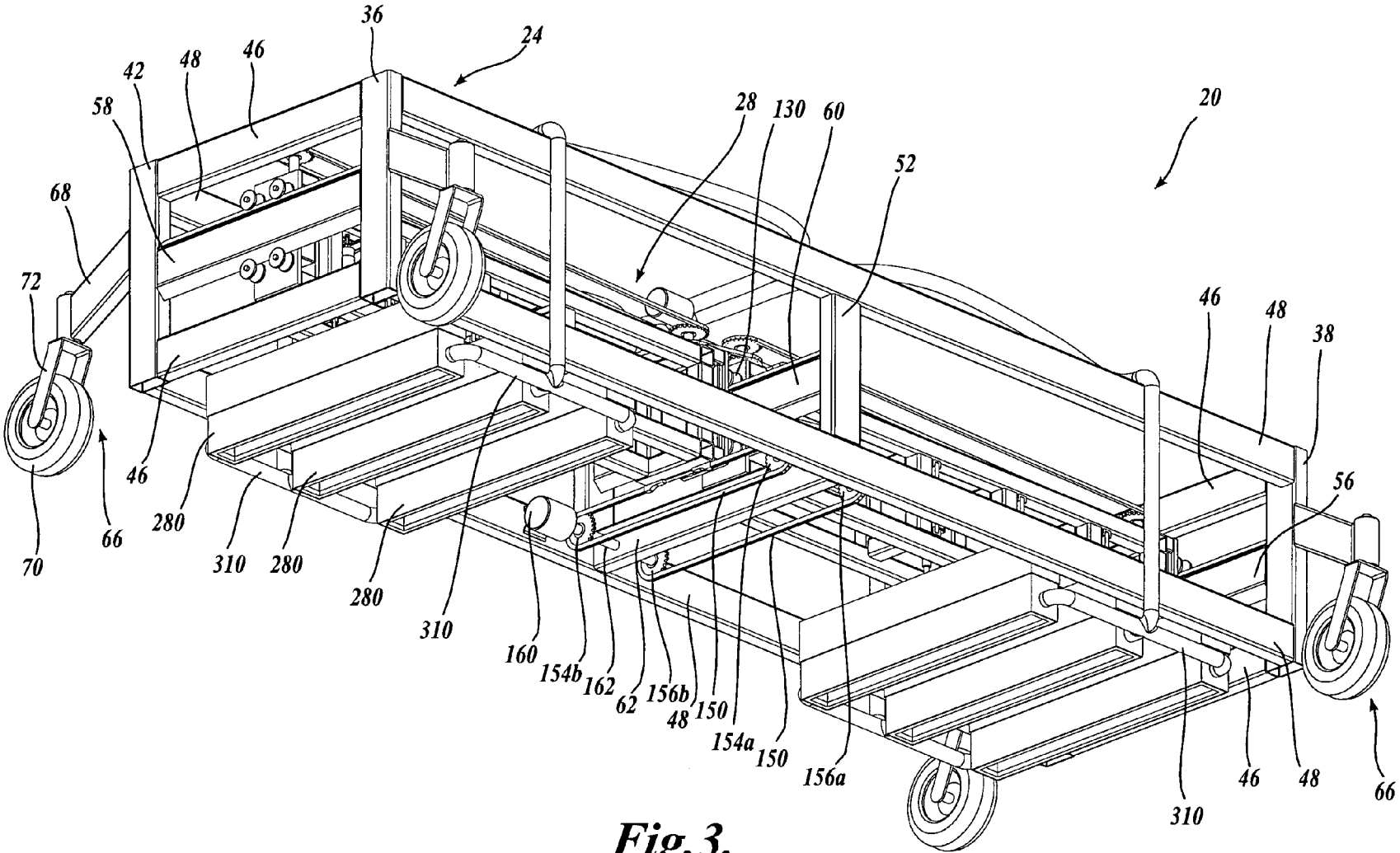
FIG. 3 is a bottom perspective view of the substrate removal apparatus of FIG. 2.

To effect such a reciprocating movement, the ends of chains 150 are connected to the lower ends of each carriage section 80 and 82, respectively, as best shown in FIG. 3. The chains 150 are entrained about pairs of sprockets 154*a* and 154*b* and 156*a* and 156*b* positioned at the lower front end and lower back end of the support frame 24, respectively, adjacent the sides of cross brace 62. The chains 150 are driven by a reversible drive source 160, such as a hydraulic motor, via a drive shaft 162 coupled to one of the sprockets 154, for example, sprocket 154*b*. In the embodiment shown, sprockets 154*b* and 156*b* are interconnected by the drive shaft 162 so that the carriage sections reciprocate using a single drive source in a synchronized manner. However, it will be appreciated that each carriage section may be driven by its own drive source and synchronized if desired, using other methods known in the art. Additionally, it will be appreciated that only one chain 150 and sprocket pair (either 154*a* and 154*b* or 156*a* and 156*b*) may be used to move the carriage in a reciprocating manner. While a motor/sprocket/chain mechanism has been illustrated for driving the carriage, it will be appreciated that other suitable driving mechanisms may be used.

Figure 8:
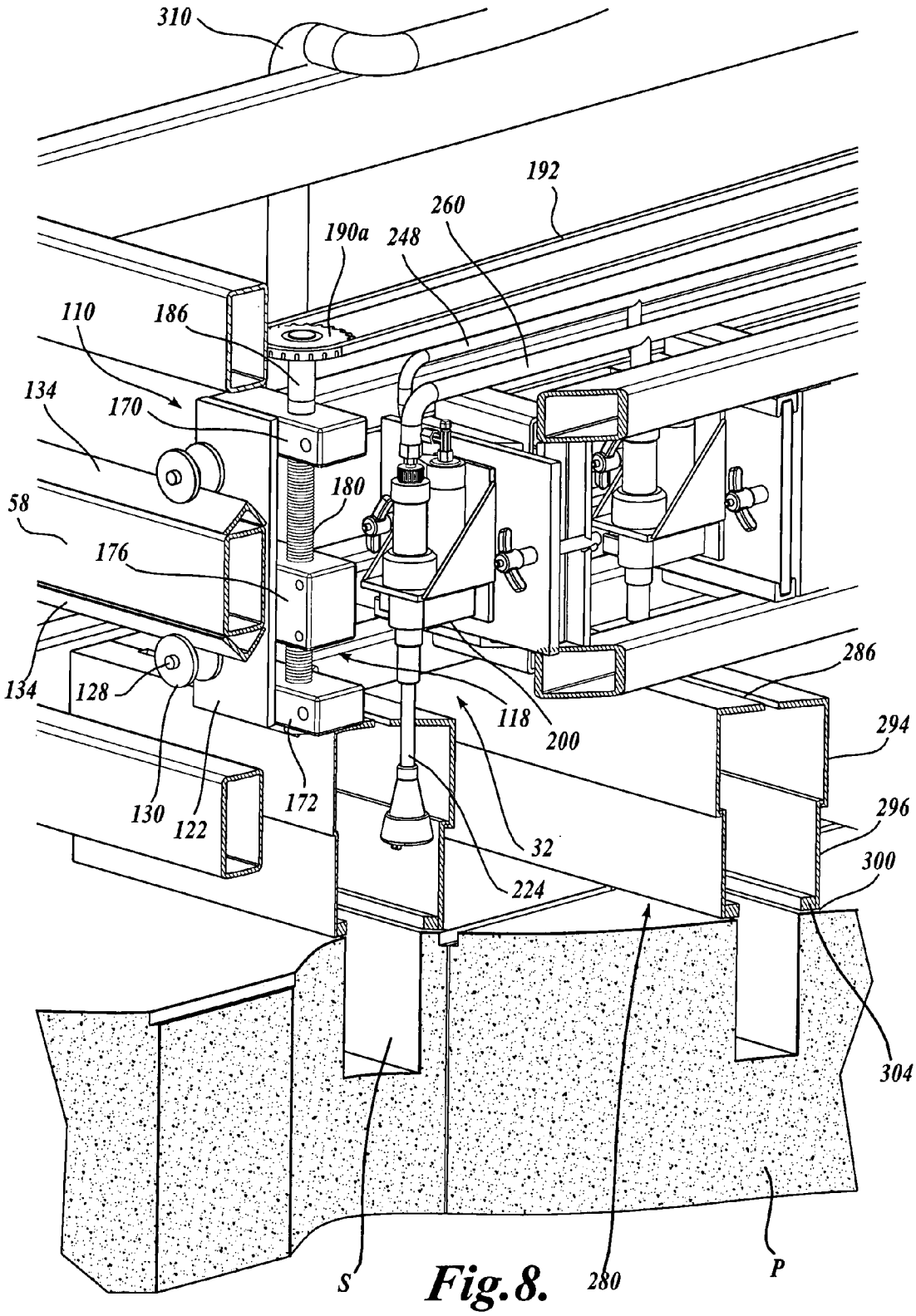
FIG. 8 is a magnified partial view of FIG. 7.

The travel assemblies 110 further permit vertical travel of the carriage 28 with respect to the support frame 24 by the actuation of the linear actuators of the travel assemblies. The linear actuators 118 are substantially identical in instruction and operation, thus only one will be described in detail. As best shown in FIGS. 4 and 8, the linear actuator 118 may comprise top and bottom stationary mounting blocks 170 and 172 secured to the end plate 122 in a spaced-apart manner, and a translatable support block 176 secured to the carriage mounting plate 114 (see FIG. 4) and positioned in-between the top and bottom blocks 170 and 172. The linear actuator 118 may further include a vertically oriented jackscrew 180 (see FIG. 8) journaled for rotation to the top and bottom mounting blocks 170 and 172 via conventional bearings (not shown). The external threads of the jackscrew 180 threadably engage with a cooperatively internally threaded through bore in the translating support block 176. As such, rotation of the jackscrew 180 imparts vertical reciprocating movement of the translatable support block 176, which in turn, moves the carriage 28 along a substantially vertical path of travel. In one embodiment, the carriage is permitted to reciprocate along a vertical path of travel of approximately 1–12 inches.

Figure 7:
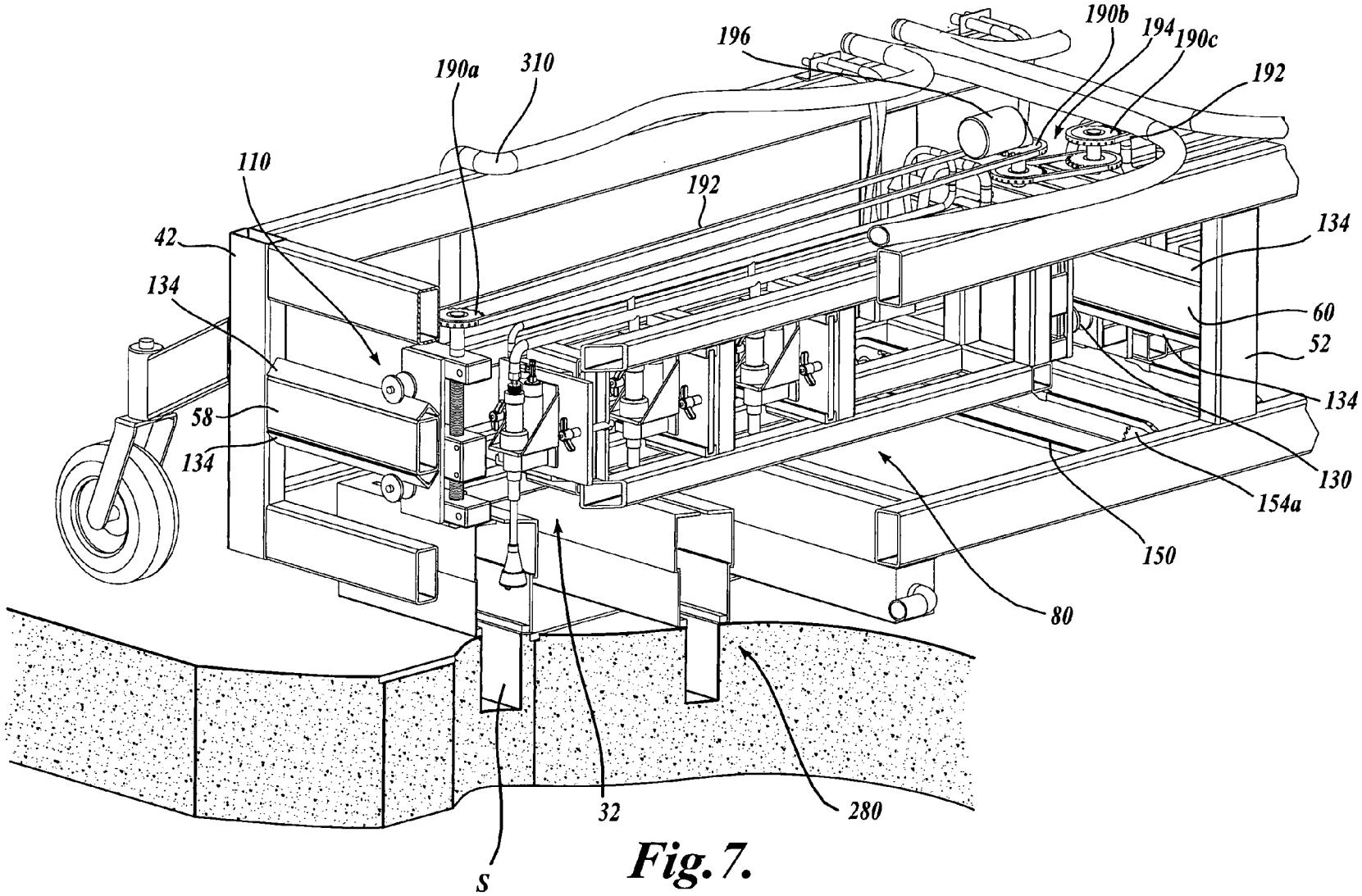
FIG. 7 is a partial cut-away view of the substrate removal apparatus in position to form slots in the surface of the substrate.

To effect such a vertically reciprocating movement, each jackscrew 180 includes a driveshaft 186 that extends beyond the respective top mounting blocks 170, as best shown in FIGS. 7 and 8. Secured to each driveshaft 186 for rotation therewith are sprockets 190*a*, 190*b*, 190*c*, and 190*d*. A drive element 192, such a chain, is entrained around pairs of sprockets 190*a* and 190*b* and sprockets 190*c* and 190*d*. In the embodiment shown, the rotation of the jackscrews 180 are synchronized by an additional chain and sprocket arrangement 194 interconnecting sprockets 190*b* and 190*c* of adjacent carriage section ends. The chains 192 are driven by a drive source 196, such as a hydraulic motor, by a suitable drive shaft (not shown) coupled to one of the sprockets, such as sprocket 190*b*, shown in FIG. 7. While the vertical travel of the carriage 28 is shown actuated by linear actuators utilizing jackscrews, it will be appreciated that other linear actuators, such as hydraulic cylinders, may also be used and can be adapted by those skilled in the art to be practiced with the present invention.

In one embodiment of the present invention, the drive sources 160 and 196 are reversible hydraulic motors. To operate the hydraulic motors, the vehicle V (see FIG. 1) as mentioned above includes a hydraulic pump, which may be driven by a suitable power take off, for example, from the internal drive source (not shown). The intake of the pump is connected to a reservoir that contains a suitable quality of hydraulic fluid. The outlet of the pump is connected by suitable hydraulic lines to each of the hydraulic motors to effect rotation of the driveshaft in the clockwise and counterclockwise directions. Suitable controls and valve arrangements known in the art may be provided to allow the vehicle operator to individually control the operation of the motors, if desired. If electric motors are to be used, the vehicle may be equipped with a suitable source of electrical power and the suitable controls known in the art to operate such a drive source. It will be apparent to one skilled in the art that apparatus 20 could be equipped with its own power source, either hydraulic or electric, and thus, would not need to rely on other vehicles or devices.

The apparatus 20 further includes a plurality of substantially identical substrate cutting assemblies utilized to form slots within the surface of the pavement. Each substrate cutting assembly 32 is coupled to the vertical cross braces 96 of the carriage sections 80 and 82, as best shown in FIG. 4 and FIG. 6. In the embodiment shown, the substrate cutting assemblies 32 are spaced apart approximately 12" (inches) at each carriage section, with approximately 60" (inches) in-between the innermost assemblies.

Referring now to FIG. 6, the substrate cutting assemblies 32 will be described in more detail. Since the substrate cutting assemblies 32 are substantially identical in construction and operation, only one substrate cutting assembly 32 will be described in detail for clarity in the ensuing description. As best shown in FIG. 6, the substrate cutting assembly 32 includes a high-pressure liquid cutting head 200 centered and securely mounted to the face of a rectangular plate 204. In the embodiment shown, the substrate cutting assemblies 32 can be removably mounted to the carriage through C-shaped brackets 210 affixed to the upper and lower longitudinal beams 90. The rectangular plate 204 of the substrate cutting assembly slides in-between the respective downwardly and upwardly opening C-shaped brackets 210 and may be retained in place by a conventional detent pin 214. The detent pin 214 extends through an opening in the plate 204 and a correspondingly sized and configured bore in the vertical cross-braces 96. Alternatively, the substrate cutting assemblies 32 may be securely mounted to the cross-braces 96 by any conventional securing methods, including rivets or welding, to name a few. In another embodiment, the substrate cutting assemblies 32 may be adapted to be adjustably mounted to the carriage in a selective manner so that the distance between the substrate cutting assemblies can be altered by the operator depending on the application.

Figure 9:
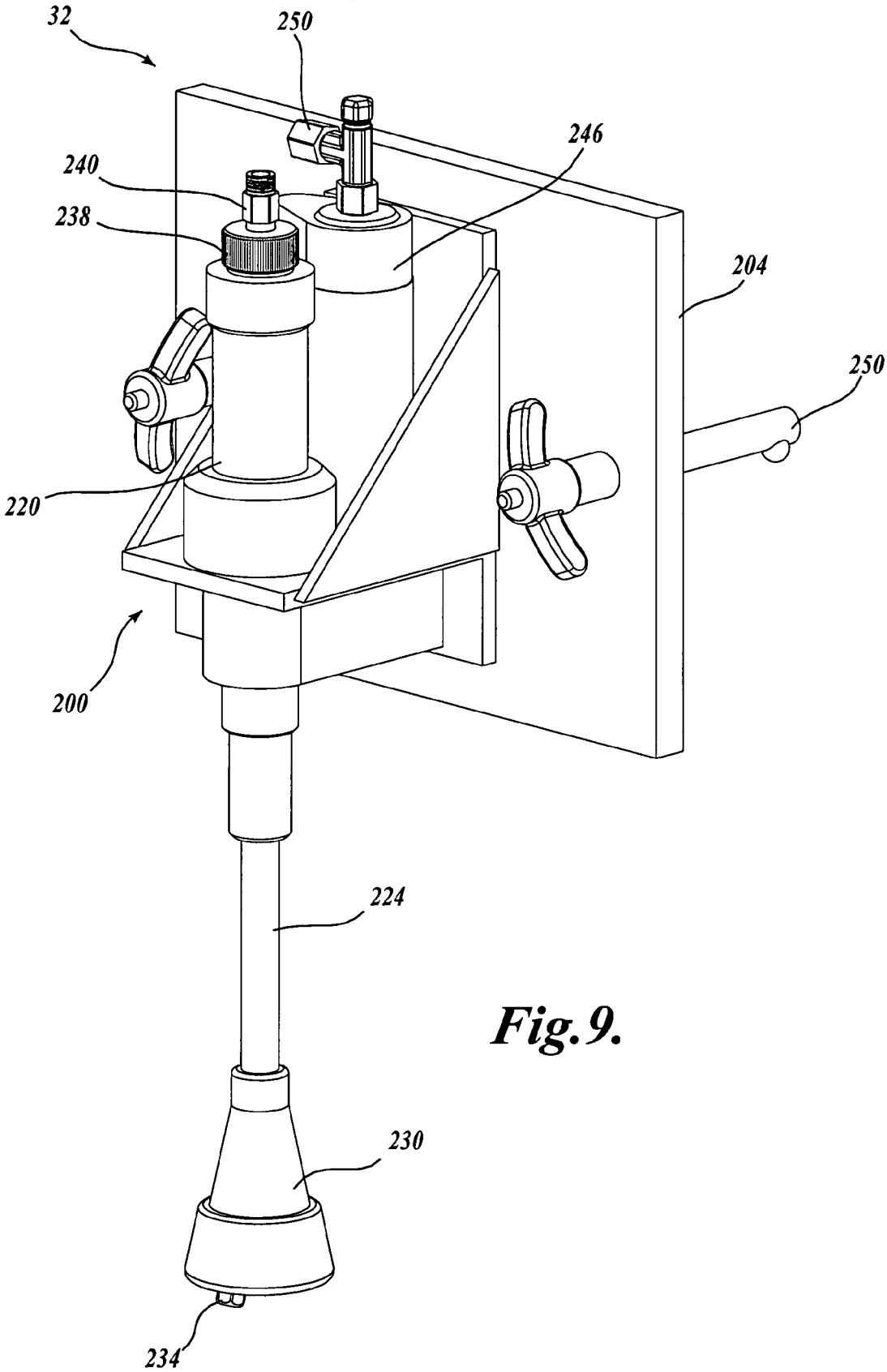
FIG. 9 is a perspective view of a substrate cutting assembly formed in accordance with one embodiment of the present invention.

FIG. 9 illustrates a perspective view of the substrate cutting assembly 32, which may include the cutting head 200 and the plate 204. The cutting head 200 includes a tubular housing 220 and a hollow nozzle shaft 224, which is rotatably mounted within the housing 220. The lower end of the nozzle shaft 224 extends outwardly from the bottom of the housing 220 and is connected to a nozzle head 230. The nozzle head 230 includes at least one nozzle discharge orifice 234. The nozzle head 230 is oriented more or less vertically for rotation about a vertical axis while the discharge orifice 234 is angularly disposed with respect to the vertical or rotational axis so that water discharges downwardly therefrom in an expanding generally cone-shaped configuration. Alternatively, the discharge orifice 234 may be oriented substantially parallel with the rotational axis of the shaft 224. The discharge orifice 234 is in fluid communication with an inlet manifold 238 of the tubular housing 220 via the hollow interior of shaft 224. A suitable inlet fitting 240 is attached to the inlet manifold 238 for introducing high pressure liquid thereinto. In other embodiments, the nozzle head 230 may include two or more discharge orifices 234 arranged in a spaced-apart manner.

The cutting head 200 further includes a hydraulic motor 246 for rotating the hollow shaft 224 via a drive transmission composed of a chain and sprocket arrangement (not shown). The hydraulic motor 246 receives sufficient hydraulic pressure from lines 248 (see FIG. 8) connected to fitting 250. The lines 248 are connected to the hydraulic pump/valve configuration located at the vehicle V, as was described above. A cutting head 200 that can suitably be practiced with the present invention is model 1140A-1, sold by NLB Corporation of Wixom, Mich., and thus will not be described in further detail. It will be apparent that the cutting head 200 is only one type of cutting head that may be used, and that other cutting heads known in the art may be practiced with the present invention, and are selected depending on their intended applications.

In the illustrated embodiment shown best in FIGS. 6 and 8, high pressure liquid, such as water, is introduced by hoses 260 into the cutting head 200 via the fitting 240 (see FIG. 9). The hose 260 passes rearwardly from the apparatus, and continues rearwardly past the vehicle V to a supply vehicle (not shown). Throughout its length, the hoses 260 may be comprised of various sections joined by suitable union means.

The supply vehicle includes a high pressure pump, driven by a suitable motor, which may be a conventional internal combustion engine. The inlet of the pump is connected by a hose to a suitable source of water, such as a reservoir carried on the supply vehicle. A bypass hose may be included to connect the pump outlet back to reservoir. The outlet of the pump is connected to the hoses 260. A suitable valve arrangement, not shown but well known in the art, uses a bypass valve to control the flow of water from the reservoir to the pump, the pump outlet to the hoses 260 or to bypass hose. In this way, the pump motor can be run continuously while water discharged from the cutting head is operated intermittently, as required, without damage to the pump and motor.

The distance of vertical and horizontal travel of the carriage, and thus the substrate cutting assemblies, may be controlled by a controller (not shown) for forming the slots to the desired dimensions. The controller is connected in electrical communication with each drive source and other components, for example, a starter switch. The controller may include a logic system for forming the slots with the desired depth and length as determined by each distinct application. It will be appreciated by one skilled in the art that the logic may be implemented in a variety of configurations, including but not limited to, analog circuitry, digital circuitry, processing units, and the like.

In one embodiment, limit switches are included to provide usable signals to the controller. The limit switches (not shown) are connected in communication with the controller and may be located adjacent the ends of one of the cross braces 56, 58, and 60. A second pair of limit switches are connected in communication with the controller and may be located adjacent to the top and bottom mounting blocks. The electrical signals produced by the limit switches may be used to control the operation of the drive sources 160 and 196, as known in the art, thus preventing further horizontal and vertical motion of the carriage 28 past these limit switches. The electrical signals produced by the horizontal limit switches may also be used by the controller to activate the vertical drive source 196 and/or to reset the position of the carriage 28 to a common start position. It will be appreciated that the vertical and horizontal limit switches can be movably mounted by any suitable mounting methods (not shown) on the mounting blocks or the end plate, and to the support frame, respectively. Accordingly, adjustment of the positioning of limit switches will set the limits of the vertical and horizontal movement of the carriage.

In an alternative embodiment, the controller may include a processing unit, a memory, and input/output (I/O) circuitry connected in a conventional manner. The memory may include random access memory (RAM), read only memory (ROM), or any other type of digital data storage means. The I/O circuitry ordinarily includes conventional buffers, drivers, relays and the like, such as for supplying power to the electric motor assemblies, or to control valves for controlling the supply of hydraulic pressure to the hydraulic motors. A set of sensors connected to the controller are also included that output a signal to the controller indicative of the vertical and/or horizontal position of the carriage. Such sensors are well known, and by way of example can be hall effect type sensors, optical sensors, or potentiometers, all of which can output a signal corresponding to the rotation of a shaft. Other sensors may be used to determine the horizontal or vertical travel distances of the carriage.

In accordance with another aspect of the present invention, shield assemblies may be used to contain lose debris as the discharged liquid impinges against the substrate. To this end, attention is directed to FIG. 3 where the apparatus 20 is shown having shield assemblies 280 secured to the lower beams 48 of the support frame 24 at the locations of the substrate cutting assemblies. As best shown in FIG. 8, the shield assemblies 280 are substantially box-like in shape and may be formed by matable halves fastened together by removable fasteners (not shown), such as threadable fasteners. At the top surface of the shield assemblies 280, a gap 286 is formed. The gap 286 has a width sufficient to receive the nozzle shaft 224 therethrough, and a length sufficient to form the desired slots. The top surface of the shield assemblies 280 may include a rubber gasket (not shown) at the location of the gap to contain the dirt and debris produced by the operation of the apparatus. Each of shield assemblies 280 includes an upper section 294 and a lower section 296 telescopingly retained by the upper section 294. The lowermost ends of the lower portion 296 may either contact the surface of the substrate or rest slightly above it. At the lowermost ends of the lower portion 296 is a rim section 300 that defines an opening into the hollow shield assemblies 280. Each shield assembly 280 may optionally include a template 304, constructed of a suitable material, such as steel, for aiding in the creation of the precision slots in the substrate P. The template 304 is connected to the lower portion 296 of the shield assembly 280 adjacent the rim section 300. The template 304 extends around the perimeter of the rim section 300 and includes suitably shaped opening of a size and configuration corresponding to the desired slots, which in one embodiment is generally rectangular.

A vacuum system may be utilized with the apparatus 20 to remove a loose mixture of substrate and liquid produced by the discharged liquid. The vacuum system includes vacuum hoses 310 connected to the ends of the shield assemblies 280 in fluid communication with the interior of the shield assemblies 280. The vacuum hoses 310 converge into collector hoses 314 (see FIG. 2), one for each carriage section 80 and 82. The collector hoses 314 are connected to a vacuum source located on the supply vehicle, which also includes a holding tank to hold the loose mixture removed from the area of the slots. In operation, vacuum pressure introduced into the interior of the shield assemblies 280 removes the loose mixture of substrate and liquid, and transports the loose mixture to the holding tank carried by the supply vehicle through hoses 310, 314.

It will be appreciated that the apparatus may include other components not shown for ease of illustration, but well known in the art, such as shrouds encasing the sprocket/chain arrangements for purposes of safety.

The operation of the apparatus 20 will be described with reference to the FIGURES according to one application, dowel bar retrofitting, of the present invention. The apparatus 20 may be transported to the site and then connected to the supply lines of the vehicle V and the supply vehicle, as necessary. The apparatus 20 is then driven to and aligned with a transverse joint J by the vehicle V. An optional parking brake assembly or similar stabilizing device of the vehicle may then be set and locked to stabilize the apparatus relative to the pavement surface, if desired. Alternatively, the weight of the vehicle V may be sufficient to stabilize the apparatus 20 during its operation. In this position, the carriage 28 may be in a predetermined start position, or is returned to a starting position. This may be achieved manually by resetting the controller, or may be achieved through an automated control sequence of the controller at the end of the prior cutting operation.

Once the apparatus 20 is in place and the carriage 28 is in the start position, the operator actuates a start command, for example, a start switch, so that the apparatus 20 operates to simultaneously form a plurality of aligned, elongated slots S. At about this time, the following actions may occur. First, liquid, for example water, is introduced from a reservoir into a high pressure pump located on a supply vehicle. The motor, which drives the pump, is set to run steadily at a predetermined speed. Next, the pump pressurizes the water into a high pressure range of about 10,000 psi to about 40,000 psi. High pressure water passes from the pump through hoses 260 to the cutting heads 200. The high pressure water is introduced into each cutting head 200 at fitting 240 and then passes through the nozzle shaft 224, which in turn, passes through nozzle discharge orifice 234 of the nozzle head 230. The water discharged from the discharge orifices 234 of each cutting head 200 defines jets of high pressure water. In this particular embodiment, the jets are angularly disposed with respect to the vertical axis of the apparatus 20. At the same time, the rotational drive sources 246, receiving sufficient hydraulic pressure through lines 248, operate to rotate the nozzle heads 230 of each cutting head 200 about vertical axes. Due to the rotating nozzle heads 230, the discharging water jets impinge against the substrate in a generally circular configuration and apply erosion and reaction forces thereto. Such forces are sufficient to cut the road approximately between 2 to 4 inches wide and approximately 2 to 6 inches in depth in this particular embodiment.

As soon as the slots S begin to be formed by liquid being discharged from the substrate cutting assemblies 32 at high pressures, the carriage 28 translates along the guide rails 134 by the operation of the drive source 160 and associated chain 150 and sprockets 154*a*, 154*b*, 156*a*, and 156*b*. In one embodiment, the horizontal drive source 160 receives a signal from the controller to begin operation, causing the carriage 28, and in turn, the substrate cutting assemblies 32, to move fore or aft of the frame along the guide rails 134. The speed of carriage 28 may be specifically selected to ensure that a predetermined amount of substrate extending to a particular depth below surface can be removed. Accordingly, as the carriage 28 translates from one end of the support frame 28 to the other, the substrate is removed to form aligned, elongated slots S.

The carriage 28 continues to move along the guide rails 134 until the pre-selected end of travel of the carriage has been reached. In one embodiment, mechanical stops may be utilized to determine the path of travel of the carriage 28. In another embodiment where limit switches are used, as the carriage 28 moves along the guide rails 134, it will contact a limit switch at one position of the support frame 24, causing a signal to be generated to reverse the direction of the drive source 160. The same signal may also be used by the controller to cause the vertical drive source 196 to vertically translate the carriage 28 through linear actuators 118 from the vertical start position to a second lower position. If, however, only one pass or scan is required, the signal from the limit switch may be used to stop the translating motion of the carriage 28, and/or to reset the position of the carriage to the original start position.

In an alternative embodiment where the controller includes a processing unit, sensors may be used that output signals to the controller indicative of the position of the carriage. Such sensors are well known, and by way of example can be hall effect type sensors, optical sensors, or potentiometers, all of which can output a signal corresponding to the rotation of a shaft. Other sensors may be used to determine the horizontal or vertical travel distances of the carriage 28 so that slots S of the desired length and depth may be formed.

Throughout these operations, the pump and motor located at the supply vehicle may run continuously. The flow of high pressure water can be controlled by either the operator or the controller through suitable control valves so as to flow either to cutting head 200 or through the bypass hose back to the reservoir.

If the optional vacuum system is to be used, vacuum pressure generated by a vacuum source located at the supply vehicle is supplied to both ends of the shield assemblies 280 through vacuum lines 310 at approximately the time water begins to discharge from the cutting heads 200. As such, the vacuum pressure removes the loose mixture of pavement and water, and transports the mixture to a holding tank carried by the supply vehicle.

In embodiments where the depth of the slots require more than one pass of the carriage 28, the carriage 28 may be vertically lowered to an appropriate position to effect a deeper cut to the elongated slots once the carriage 28 has horizontally translated through one scan. Then, the carriage 28, and in turn, cutting heads 200 are moved horizontally in the opposite direction to deepen the elongated slots S. Both of these actions may be controlled by the controller and by signals generated from associated sensors or switches. It will be appreciated that additional passes or scans of the carriage may be achieved, if desired, depending on the desired depth of the slots. As such, the depth of the slots typically determines the required number of passes. In the embodiment shown, each pass removes approximately 2.5 inches in depth.

Once the final pass is complete, the supply of high pressure water is shut off, and the vacuum system can be deactivated. The carriage 28 is raised vertically, preferably to a starting position, thus retracting the nozzle heads 230. The apparatus 20 is then driven to the next transverse joint J and the steps of the preceding paragraphs are then repeated until the job is completed. After the slots S have been formed, a dowel bar is inserted into each slot. Thereafter, the slots are refilled with the appropriate bonding material in order to make the road ready for vehicular traffic again.

It will be appreciated by those skilled in the art that the apparatus 20 has several advantages over the prior art. For example, there is no need for removing a "plug," since the cutting action of the discharged liquid breaks up the substrate to form the slots. The loose mixture of substrate and liquid may be removed by pressure or vacuum leaving an empty slot. Additionally, the surfaces of the slots formed by the cutting heads are sufficiently rough to provide good bonding surfaces, so there is no need for further preparation of the slots, i.e., sand blasting the slots. Thus, as will be appreciated to those skilled in the art, the apparatus of the present invention provides a faster, more cost effective method of dowel bar retrofitting.

While the embodiments of the invention have been illustrated and described, it will be appreciated that various changes can be made therein without departing from the spirit and scope of the invention. For example, while the apparatus is shown being moved by a vehicle V, it will be appreciated that the apparatus can be adapted by those skilled in the art to attach to the front of the supply vehicle, or to be pulled behind the vehicle V. Additionally, while the apparatus is shown having one shield assembly associated with each substrate cutting assembly, it will be appreciated that shield assemblies having larger dimensions may be utilized by the present invention that are associated with two or more substrate cutting assemblies. Further, while the apparatus is shown using a rectangular carriage constructed of a plurality of tubular members, it will be appreciated that the carriage may have a simplified construction, such as a single tubular member to which the substrate cutting assemblies, or just the cutting heads, are secured. In this embodiment, the travel assemblies described above, or other mechanisms that accomplish the same functions as the travel assemblies, may be utilized to movably support the simplified carriage within the support frame. Thus, the scope of the invention

What is claimed is:

1. An apparatus for cutting at least six slots into a surface of a substrate, comprising:

a support frame having a front end and a rear end;

a carriage movably carried by the support frame, the carriage reciprocally movable along a first path of travel between the front and rear ends of the support frame; and at least six spaced-apart and substantially collinearly arranged cutting devices carried on the carriage for movement therewith, the cutting devices each including at least one discharge orifice coupled in fluid communication with a source of high pressure liquid for supplying pressurized liquid to the orifice, the pressurized liquid being discharged from the cutting devices at the discharge orifices with sufficient discharge pressure for simultaneously cutting at least six slots into the surface of the substrate.

2. The apparatus of claim 1, wherein the support frame is adapted to traverse the surface of the substrate.

3. The apparatus of claim 1, further comprising a first drive source associated with the carriage for effecting reciprocal movement of the carriage along the first path of travel.

4. The apparatus of claim 3, further comprising linear actuators coupled to the ends of the carriage, the first drive source drivingly connected to the linear actuators for effecting movement of the carriage along the first path of travel.

5. The apparatus of claim 1, wherein the first path of travel is substantially parallel to the surface of the substrate.

6. The apparatus of claim 1, wherein the carriage is further reciprocally movable with respect to the support frame along a second path of travel different than the first path of travel.

7. The apparatus of claim 6, wherein the second path of travel is substantially orthogonal to the first path of travel.

8. The apparatus of claim 6, wherein the second path of travel is vertically oriented with relation to the surface of the substrate.

9. The apparatus of claim 6, further comprising a second drive source associated with the carriage for effecting reciprocal movement of the carriage along the second path of travel.

10. The apparatus of claim 9, further comprising linear actuators coupled to the ends of the carriage, the second drive source drivingly connected to the linear actuators for effecting movement of the carriage along the second path of travel.

11. The apparatus of claim 1, wherein the cutting device has an operating position substantially orthogonal to the surface of the substrate.

12. The apparatus of claim 1, wherein each cutting device further includes a drive source coupled to the discharge orifice for rotating the discharge orifice about an axis.

13. The apparatus of claim 12, wherein the orientation of the rotational axis is generally vertical in relation to the surface of the substrate.

14. The apparatus of claim 1, further comprising at least one shield assembly connected to a lower portion of the support frame and associated with one cutting device, the shield assembly defining an interior cavity having a rim section forming an opening to the substrate, wherein the cutting device extends into the shield assembly.

15. The apparatus of claim 14, wherein the shield assembly is adapted to be connected in fluid communication with a vacuum source for removing a mixture of loose substrate and liquid produced by the discharging liquid impinging against the surface of the substrate.

16. The apparatus of claim 14, wherein the shield assembly includes a template coupled to a lower portion of the shield assembly and occupying the opening formed by the rim section, the template configured to extend around the rim section and include an opening corresponding in shape and size with the slot to be formed in the substrate.

17. The apparatus of claim 1, wherein at least one of the cutting devices is removably coupled to the carriage.

18. An apparatus for cutting a plurality of slots into a surface of a substrate, comprising:

a mobile support frame having a front end and a rear end, a carriage moveably carried by the support frame, the carriage reciprocally movable along a first path of travel between the front and rear ends of the support frame; and first and second sets of cutting devices carried on the carriage for movement therewith and spaced apart a distance of approximately 60 inches, wherein the first and second sets of cutting devices each includes three cutting devices equally spaced apart a distance of approximately 12 inches, the cutting devices each including at least one discharge orifice, wherein the cutting devices are adapted to be connected to a source of high pressure liquid for supplying pressurized liquid to the discharge orifices, the pressurized liquid being discharged from the cutting devices at the discharge orifices with sufficient discharge pressure for simultaneously cutting six spaced slots in the substrate.

19. An apparatus for cutting a plurality of slots into a surface of a substrate, comprising:

a mobile support frame having a front end and a rear end;

a carriage moveably carried by the support frame, the carriage reciprocally movable along a generally horizontal path of travel between the front and rear ends of the support frame, the carriage further reciprocally movable with respect to the support frame along a generally vertical path of travel;

at least six substantially collinearly arranged cutting devices carried on the carriage in a spaced apart manner for movement therewith, the cutting devices each including a tubular shaft and at least one discharge orifice coupled in fluid communication with the shaft, the shaft having a generally vertical operating position, wherein the shaft is adapted to be connected to a source of high pressure liquid for supplying pressurized liquid to the shaft, the pressurized liquid being discharged from the cutting devices at the discharge orifices with sufficient discharge pressure for simultaneously cutting at least six spaced slots in the substrate;

a first drive source drivingly connected to the carriage for effecting reciprocal movement of the carriage along the generally horizontal path of travel; and a second drive source drivingly connected to the carriage for raising and lowering the carriage along the generally vertical reciprocal path of travel.

20. A method for simultaneously cutting at least six spaced-apart slots in a surface of a substrate with at least six high pressure liquid cutting heads carried on a frame in spaced relation, the method comprising:

positioning the frame in a desired location with respect to the surface of the substrate with the at least six cutting heads positioned above a portion of the surface of the substrate in which slots are to be cut; and discharging liquid at high pressure from the at least six high pressure liquid cutting heads to impinge against the surface of the substrate with sufficient force to simultaneously cut at least six, spaced slots in the surface of the substrate.

21. The method of claim 20, further comprising:

moving the cutting heads from a first position in a first direction substantially parallel to the surface of the substrate and relative to the frame to elongate the slots.

22. The apparatus of claim 18, wherein the discharge pressure of the liquid is greater than 30,000 p.s.i.

23. The apparatus of claim 1, wherein the substrate is concrete.

24. The apparatus of claim 18, wherein the substrate is concrete.

25. The apparatus of claim 19, wherein the substrate is concrete.

26. The method of claim 20, wherein the substrate is concrete.

* * * * *